US005467713A

United States Patent [19]

Roosmann et al.

[11] Patent Number: 5,467,713

[45] Date of Patent: Nov. 21, 1995

[54] IGNITION AND SAFTY DEVICE FOR A GRENADE PROJECTILE PROVIDED WITH A SHAPED CHARGE INSERT

[75] Inventors: Karl-Heinz Roosmann; Ulf Hahn, both of Ratingen, Germany

[73] Assignee: Rheinmetall GmbH, Ratigen, Germany

[21] Appl. No.: 321,895

[22] Filed: Oct. 14, 1994

[30] Foreign Application Priority Data

Oct. 14, 1993 [DE] Germany ..... 43 35 022.4

[51] Int. Cl.[6] ..... F42C 15/26; F42C 15/22; F42C 9/16

[52] U.S. Cl. ..... 102/233; 102/231; 102/235; 102/245; 102/269

[58] Field of Search ..... 102/231, 232, 102/233, 235, 254, 245, 277.1, 266, 269

[56] References Cited

U.S. PATENT DOCUMENTS

| | | | |
|---|---|---|---|
| 4,534,292 | 8/1985 | Weber et al. | 102/245 |
| 4,736,682 | 4/1988 | Roosmann | 102/269 |
| 4,969,397 | 11/1990 | Günther et al. | 102/233 |
| 5,022,325 | 6/1991 | Skowasch et al. | 102/245 |
| 5,048,419 | 9/1991 | Skowasch | 102/226 |
| 5,206,457 | 4/1993 | Pascal et al. | 102/235 |
| 5,275,101 | 1/1994 | Chemiere et al. | 102/235 |

FOREIGN PATENT DOCUMENTS 0255130 2/1988 European Pat. Off. .

*Primary Examiner*—Charles T. Jordan
*Assistant Examiner*—Theresa M. Wesson
*Attorney, Agent, or Firm*—Spencer, Frank & Schneider

[57] ABSTRACT

An ignition and safety device for a grenade projectile provided with a shaped charge insert and having a bottom-side impact fuse that has a spin-dependent safety element and acceleration-dependent safety element (14, 17), and a self-destruct device. The self-destruct device includes a pyrotechnical delay segment (29) that is axially displaceable into engagement with a firing pin (30) by means of the launch acceleration and acts on a booster charge (8), which is disposed extremely off-center of the projectile axis for the projectile effective charge. Consequently, no shaped charge jet is formed during self-destruction for the projectile.

5 Claims, 1 Drawing Sheet

IGNITION AND SAFTY DEVICE FOR A GRENADE PROJECTILE PROVIDED WITH A SHAPED CHARGE INSERT

REFERENCE TO RELATED APPLICATIONS

This application claims the priority of German application Serial No. P 43 35 922.4 filed Oct. 14, 1993, which is incorporated herein by reference.

BACKGROUND OF THE INVENTION

The invention relates to an ignition and safety device for a grenade projectile provided with a shaped charge insert. More specifically the present invention relates to an ignition and safety arrangement for a base-side impact fuse for a grenade projectile provided with a shaped charge insert, which fuse includes a housing for attaching to the a spin-dependent safety element and an acceleration-dependent safety element for preventing arming of the fuse until the fuse has been subjected to a launch acceleration and a given centrifugal force, and a self-destruct device.

A grenade projectile provided with a shaped charge insert is known from German published patent application 38 35 888 A1 (corresponding to U.S. Pat. No. 4,969,397). This projectile is provided with a bottom-side impact or percussion fuse as part of an ignition and safety device that has a spin-dependent element and an acceleration-dependent safety element. In addition, it includes a self-destruct device which becomes effective after spin decay. The impact fuse encompasses a pivotable detonator carrier, which is acted upon by the two safety elements, which is seated eccentrically by means of a pin and which is pivotable transversely to the longitudinal axis of the projectile under centrifugal force, and an axially displaceable firing pin, so that the detonator is disposed axially adjacent to the firing pin due to launching, and as a result is ignited during impact. A firing pin carrier for the firing pin is likewise acted upon by a sequential action acceleration-dependent and spin-dependent locking. In the case of a dud, the self-destruct device causes an activation of the explosive train following the failed impact ignition. Because of this, however, a shaped charge jet is formed, as in normal impact ignition, by means of initiation of the effective charge, which jet leads to a jeopardizing of the rifleman or other persons. Thus, the self-destruct device is not redundant.

It is known from German published patent application No. 39 24 235 A1 (corresponding to U.S. Pat. No. 5,048,419) to provide bomblet projectiles with an axially displaceable main firing pin and a slide that has a detonator charge and is displaceable transversely to the projectile direction, in which instance a primer of a pyrotechnical delay segment, which is disposed transversely to the projectile axis, is provided in the slide for self-destruction of the projectile. This primer can be ignited by a second firing pin disposed laterally in the fuse housing. Also in this case, the detonator charge is ignited by the delay segment after a predetermined delay time.

SUMMARY OF THE INVENTION

It is the object of the invention to create an ignition and safety device arrangement for a base-side impact fuse of the type first mentioned above for a grenade projectile provided with a shaped charge insert which arrangement prevents the formation of a shaped charge jet during self-destruction.

This object generally is accomplished according to the present invention by an ignition and safety arrangement for a base-side impact fuse for a grenade projectile provided with a shaped charge insert, wherein the fuse has a housing for attachment to the projectile; a spin-dependent safety element and an acceleration-dependent safety element mounted in the housing for preventing arming of the fuse until the fuse has been subjected to a launch acceleration and a given centrifugal force; and a self-destruct device disposed in the housing for igniting the shaped charge, with the self-destruct device including a firing pin, a pyrotechnical delay segment, means for mounting the pyrotechnical delay segment in the housing for axial displacement into engagement with the firing pin in response to launch acceleration, and a booster charge for igniting the shaped charge, with the booster charge being mounted in the housing extremely off-center and being ignited by the delay segment after its delay time.

During launch of a grenade and after the release of two independently-acting safety elements, a pyrotechnical delay segment is initiated by the launch acceleration. In the case of a dud, an ignition intensifier positioned at the outer edge of the effective charge is ignited by an initial detonator of the delay segment. Because of the extremely off-center arrangement of the ignition intensifier, no shaped charge jet can form, and the grenade only detonates with a reduced fragmentation effect at short range. In the case of self-destruction, an absolutely redundant explosive train is activated, which even fulfills its function should the actual detonator of the impact fuse not reach its final igniting position. Furthermore, a simple construction with increased functioning reliability of the igniter results.

Further modifications and features of the invention are likewise described in the claims.

The invention is described in detail below by use of an embodiment illustrated in the attached drawings.

DETAILED DESCRIPTION OF THE PREFERRED EMBODIMENT

Figure 1:
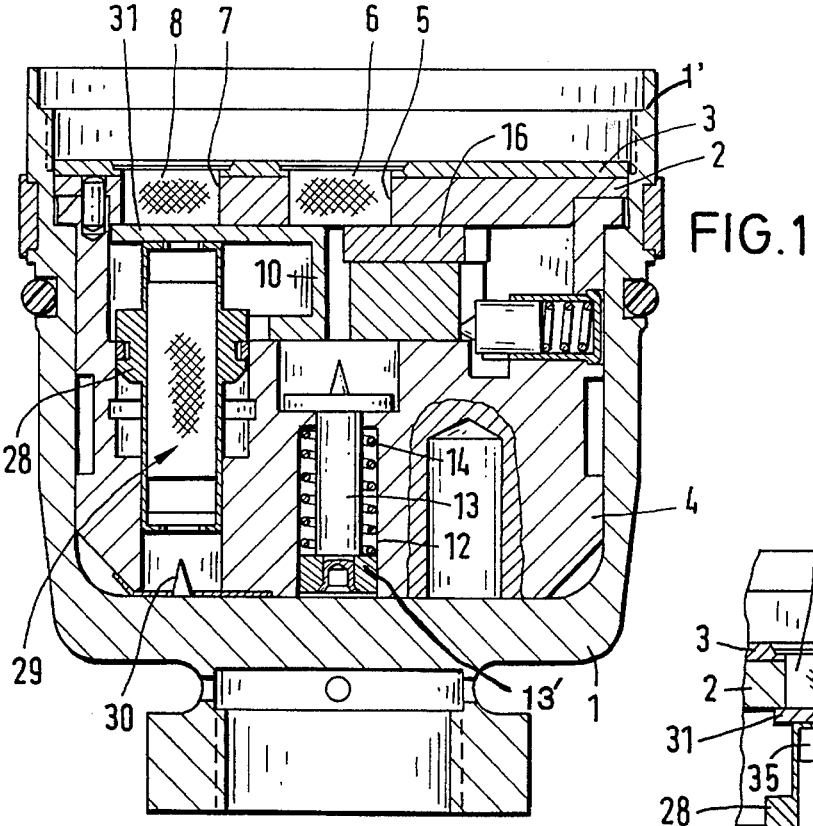
FIG. 1 is an axial sectional view of an ignition and safety device according to the invention for a grenade provided with a shaped charge insert.
Figure 3:
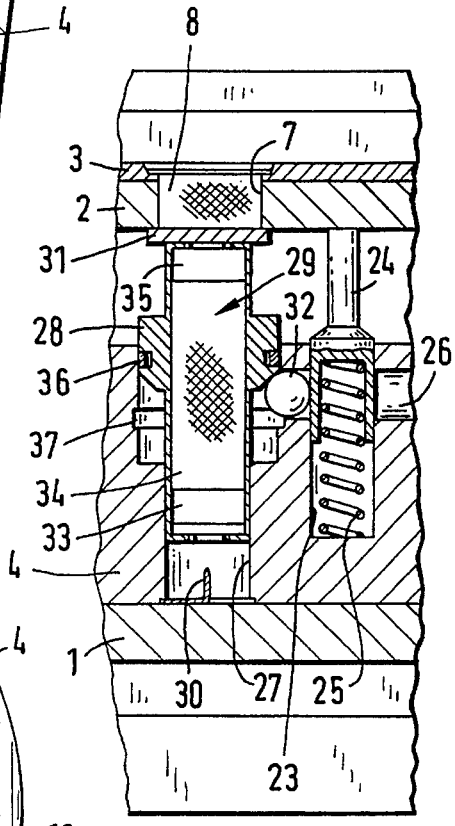
FIG. 3 is a sectional view along line III—III of FIG. 2.
Figure 2:
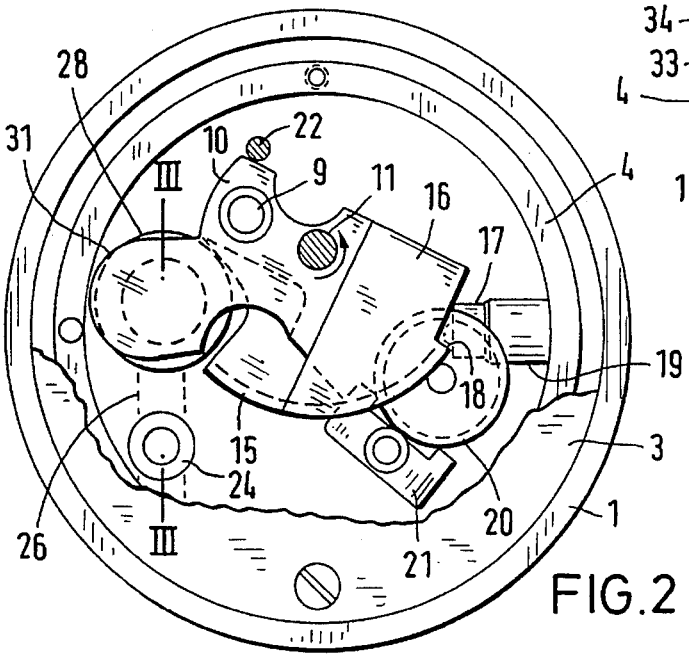
FIG. 2 is a plan view of the device of FIG. 1.

The illustrated ignition and safety device for a grenade projectile (not shown) provided with a shaped charge insert that is effective in the forward direction, is disposed in a rearward or base-side projectile housing 1, and encloses an intermediate housing 4, which is inserted into projectile housing 1 and secured there by a plate 2 and a spacer 3. Plate 2 is screwed to intermediate housing 4 in the region of a circumferential, front-side flange 1'.

A central bore 5 for receiving a booster charge 6, and a bore 7 disposed extremely off-center, that is, adjacent to the outer circumference, for receiving a further booster charge 8, are respectively provided in plate 2 and spacer 3. Booster charges 6, 8 serve to ignite the effective charges (not shown) of the projectile. Booster charge 6 serves in the igniting connection between a detonator charge 9 of an impact fuse and the effective charge of the projectile. The detonator charge 9 is received by a detonator carrier 10 of the impact fuse located adjacent to plate 2. This carrier 10 is pivotable around a pivot pin 11 in a plane perpendicular to the longitudinal axis of the projectile.

Located in intermediate housing 4 is an axial bore 12, into which a firing pin 13 is inserted and pressed in the direction of the bottom of the projectile against projectile housing 1 by means of a spring 14 supported against intermediate housing 4 and a band 13' on the rear of firing pin 13. In the illustrated safety position, therefore, the tip of firing pin 13 is spaced with respect to detonator carrier 10 as shown.

Furthermore, detonator carrier 10 has a gear 15 segment as part of an intermittent safety gearing, and an imbalance mass part 16 to increase the centrifugal force effect.

As a spin-dependent safety element, a blocking member 17, which is spring-loaded radially inwardly, is provided laterally next to detonator carrier 10 in the form of a cylinder with a tip. This cylinder extends behind a projection 18 of detonator carrier 10 and normally blocks it. The blocking function of blocking member 17 can be eliminated under centrifugal force by outward displacement of the member 17 counter to the spring prestress. Blocking member 17 is displaceably seated in a sleeve 19 secured to intermediate housing 4.

Also included in the intermittent safety gearing, which serves as the bore and muzzle area safety and temporally delays the pivoting movement of detonator carrier 10, are a toothed wheel 20, which meshes with gear segment 15, as well as a double-lever-type armature 21 which is in engagement with toothed wheel 20 and is secured to intermediate housing 4.

In the initial position, detonator carrier 10 is supported against a stop pin 22 secured in plate 2, while, as a consequence of the spin during launch, because of imbalance mass portion 16, detonator carrier 10 is rotated so far around pivot pin 11 that detonator charge 9 is positioned above the tip of firing pin 13, which remains in its initial position until impact. Because of gravitational force, upon impact firing pin 13 moves counter to its spring prestress in the direction of detonator charge 9 and ignites it. As a result, booster charge 6 and subsequently the effective charge (not shown) are ignited, the effective charge acting symmetrically on the shaped charge insert of the projectile in order to produce a shaped charge jet.

For the case of a dud, a further pyrotechnical burning segment is provided. In this instance a pin 24 is seated in a bore 23 of intermediate housing 4, parallel to the axis of the projectile. This pin 24 is pressed against plate 2 by a spring 25 supported against the bottom of bore 23. A bore 26, which ends in a stepped axial bore 27 disposed axially aligned with bore 7 for booster charge 8, extends transversely to bore 23. Axial bore 27 receives a plunger 28, which is provided on both ends with an axial opening and in turn receives a delay fuse composition 29, while a further firing pin 30 is disposed, as an upwardly-bent tongue of a strip, at the bottom of the bore 27 on the projectile housing 1. In the initial position, plunger 28 is separated from booster charge 8 by an extension 31 of detonator carrier 10, and simultaneously held in its position separated from firing pin 30 by a ball 32, which rests against a rear side of plunger 28 and is pressed against it by pin 24, so that plunger 28 rests against extension 31.

Delay ignition composition 29 includes, for example, a primer 33, a delay segment 34 and an initial detonator 35.

Because of its gravitational force, pin 24 releases ball 32 during the launch of the projectile, so that plunger 28 is released for axial movement counter to the flight direction of the projectile until an expander ring 36 disposed in a circumferential groove at the circumference of the plunger 28 falls partly into a circumferential groove 37 in axial bore 27 and holds plunger 28 in this retracted position. In this position, delay ignition composition 29 is ignited in that it engages firing pin 30. Through appropriate selection of the time delay, delay segment 34 reliably prevents booster charge 8 from being ignited before the projectile has reached the end of its flight path.

Normally, the ignition of the effective charge (not shown) is brought about by the impact fuse at the end of the projectile flight path. If, however, this fails to occur for some reason, the ignition of booster charge 8 and thus of the effective charge by delay ignition composition 29 leads to self-destruction. The latter is, however, not associated with the formation of a shaped charge jet, because booster charge 8 ignites the effective charge off-center, so that the effective charge acts in an asymmetric manner on the shaped charge insert, and the grenade only detonates with a reduced fragmentation effect at short range.

In the case of self-destruction, therefore, an absolutely redundant explosive train is activated that even fulfills its function should detonator 9 not reach its final ignition position.

The invention now being fully described, it will be apparent to one of ordinary skill in the art that any changes and modifications can be made thereto without departing from the spirit or scope of the invention as set forth herein.

What is claimed:

1. An ignition and safety arrangement for a base-side impact fuse for a grenade projectile provided with a shaped charge insert, said fuse having: a housing for attaching to the projectile; a spin-dependent safety element and an acceleration-dependent safety element mounted in said housing for preventing arming of the fuse until the fuse has been subjected to a launch acceleration and a given centrifugal force; and a self-destruct device disposed in said housing for igniting the shaped charge, with said self-destruct device including a firing pin, a pyrotechnical delay segment, means for mounting said pyrotechnical delay segment in said housing for axial displacement into engagement with said firing pin in response to launch acceleration, and a booster charge for igniting the shaped charge, with said booster charge being mounted in said housing extremely off-center and being ignited by said delay segment after its delay time.

2. An arrangement as defined in claim 1, wherein said impact fuse further includes a detonator carrier that is mounted in said housing and pivotable transversely to the longitudinal axis of said housing, and said carrier having a portion which extends between and separates said pyrotechnical delay segment from said booster charge in the initial position of said carrier.

3. An arrangement as defined in claim 2, wherein said means for mounting said pyrotechnical delay segment includes a stepped plunger that supports an expanding ring on its circumference, an axial bore in which said plunger is mounted, and a groove disposed on the wall of said bore and into which said expanding ring partly falls because of the launch acceleration to hold said plunger in a position axially distanced from said detonator carrier.

4. An arrangement as defined in claim 1 further comprising means for holding said pyrotechnical delay segment in an initial position including a radially movable ball mounted for radial movement in a radially extending bore in said housing, and an axially moveable pin mounted in said housing under spring prestress counter to the launch direction, with said pin laterally pressing said ball against said plunger until said pin is released in response to launch acceleration.

5. An arrangement as defined in claim 1 wherein said impact fuse includes a firing pin mounted in said housing for movement along the longitudinal axis of the projectile and under spring prestress against the bottom of said housing.

* * * * *